US007976595B2

(12) United States Patent
Wang et al.

(10) Patent No.: US 7,976,595 B2
(45) Date of Patent: Jul. 12, 2011

(54) METHOD OF GASIFICATION BURNER ONLINE FEEDING

(75) Inventors: Xin Wang, Zoucheng (CN); Minglin Zhang, Zoucheng (CN); Qingrui Zhu, Zoucheng (CN); Min Zhu, Zoucheng (CN); Jiyong Zhang, Zoucheng (CN); Xinfang Jiang, Zoucheng (CN); Yifei Zhang, Zoucheng (CN); Yongkui Sun, Zoucheng (CN); Mei Han, Zoucheng (CN); Weihua Zhang, Zoucheng (CN)

(73) Assignee: Yankuang Group Corporation Limited, Zoucheng (CN)

( * ) Notice: Subject to any disclaimer, the term of this patent is extended or adjusted under 35 U.S.C. 154(b) by 819 days.

(21) Appl. No.: 12/031,180

(22) Filed: Feb. 14, 2008

(65) Prior Publication Data

US 2008/0216406 A1 Sep. 11, 2008

(30) Foreign Application Priority Data

Feb. 14, 2007 (CN) ..... 2007 1 0013320

(51) Int. Cl.

| | |
|---|---|
| ***C01B 3/36*** | (2006.01) |
| ***C01B 6/24*** | (2006.01) |
| ***C01B 3/02*** | (2006.01) |
| ***C01B 3/24*** | (2006.01) |
| ***C10J 3/00*** | (2006.01) |
| ***B01J 7/00*** | (2006.01) |

(52) U.S. Cl. ..... 48/197 R; 48/61; 48/210; 423/644; 423/648.1; 423/650

(58) Field of Classification Search ..... 48/61, 197 R, 48/202; 423/644, 648.1, 650

See application file for complete search history.

(56) References Cited

U.S. PATENT DOCUMENTS

| | | | | |
|---|---|---|---|---|
| 3,871,839 | A * | 3/1975 | Moody | 48/197 R |
| 4,280,817 | A * | 7/1981 | Chauhan et al. | 44/604 |
| 4,353,712 | A * | 10/1982 | Marion et al. | 48/197 R |
| 4,400,180 | A * | 8/1983 | Marion et al. | 48/197 R |
| 5,087,271 | A * | 2/1992 | Stellaccio et al. | 48/197 R |
| 5,855,631 | A * | 1/1999 | Leas | 48/197 R |
| 6,033,447 | A * | 3/2000 | Moock et al. | 48/197 R |
| 2009/0178338 | A1 * | 7/2009 | Leininger et al. | 48/86 R |

* cited by examiner

*Primary Examiner* — Alexa D Neckel
*Assistant Examiner* — Matthew J Merkling
(74) *Attorney, Agent, or Firm* — Kenyon & Kenyon LLP

(57) ABSTRACT

A method of gasification burner online feeding for a coal-water slurry gasifier, where a coal-water slurry line and an oxidizer line are both protected by shield gas. The method may realize online, pressurized and continuous feeding of the gasification burners which are fixed after they stalled for other reasons than their own, thus greatly reducing the probability of accidental shutdown of gasifiers and improving the reliability of long-term service of the multi-nozzle opposed gasifier.

8 Claims, 1 Drawing Sheet

METHOD OF GASIFICATION BURNER ONLINE FEEDING

RELATED APPLICATIONS

This application claims the benefit of Chinese Patent Application No. 200710013320, filed Feb. 14, 2007, the contents of which are incorporated herein by reference.

FIELD OF THE INVENTION

The present invention relates to a gasification burner online feeding method for an entrained-flow-bed gasifier in the coal gasification field. Particularly, the present invention relates to a gasification burner online feeding method for an entrained-flow-bed gasifier with coal-water slurry as raw material, wherein under normal operating conditions, the once stalled gasification burners can realize online, continuous and pressurized feeding without shutdown of the gasifier.

BACKGROUND OF THE INVENTION

The well-known solution, like the technologies disclosed by Chinese Patent No. ZL98110616.1 Multi-Nozzle Opposed Coal-water Slurry or Dry Pulverized Coal Gasifier and Use of the Same and Chinese Patent No. ZL01210097.8 Multi-Nozzle Opposed Coal-water Slurry or Pulverized Coal Gasifier with Nozzles Provided on the Top Thereof, is that, during the coal gas gasification process in a multiple-nozzle-opposed entrained-flow bed with hydrocarbon compounds as raw materials, oxygen, and coal-water slurry enter into the gasifier through a plurality of nozzles to form an impinging stream, thus enhancing mixture and heat calorie transmission. The engineering practice shows that the multi-nozzle-opposed entrained-flow bed gasifier is stable in operation, advanced in technical indexes, and low in oxygen and coal consumption. Therefore, it is suitable for large-scale production. The gasifier is charged by a plurality of burners which are mutually standby. Therefore, even when some of the burners fail to function, the gasifier can still work, thus avoiding breakdown of the follow-up systems.

If some burners stall during the operation of the gasifier, and it is determined that the failure is not caused by the burners per se, it is very important to make said burners perform online pressurized feed and the gasifier resume normal operation, with the maintenance of the gasifier not prejudicing the follow-up systems' operation. Thereby, the probability of the gasifier's accidental stall will be greatly reduced, and the reliability of long-term service of the multi-nozzle opposed gasifier will be improved, which also has a great significance on further improving the stability and continuity of the operation of the whole production system.

Therefore, it is urgent for coal chemical enterprises to be equipped with a multi-nozzle feeding gasifier, which, under normal operation, can enable gasification burners to perform online pressurized feeding, thus further exhibiting the advantages of the multi-nozzle feeding gasifier.

SUMMARY OF THE INVENTION

Some gasifier burners stall for other reasons rather than their own. These gasification burners cannot realize an online continuous feeding during the operation of the gasifier, even after they are fixed. With a purpose to overcome the above defect, the present invention provides an online feeding method for gasification burners. During the operation of the gasifier, if some burners stall and it has been determined that the failure is not caused by themselves, the method can enable the once stalled burners to feed continuously and online and the gasifier to resume its normal operation, with the maintenance of the gasifier not prejudicing the follow-up systems' operation. Therefore, the probability of emergency breakdown of gasifiers will be reduced and the reliability of the gasifiers' long-term operation will be improved.

The technical solution of the present invention is as follows:

According to a method of gasification burner online feeding, a first pressure regulating valve or/and a first restriction orifice is applied to the coal-water slurry circulation line of a gasifier, a pressure transmission control device is connected to an outlet of a coal-water slurry pump, the control end of the device being connected with the first pressure regulating valve; the coal-water slurry line between a first slurry line cut-off valve of the coal-water slurry feeding line and the gasification burner is connected to a shield gas line through a first shield gas cut-off valve. A second pressure regulating valve and/or a second restriction orifice is applied to an oxidizer vent line of the gasifier, and a pressure display control device is connected to an outlet of a flow regulating valve, the control end of the device being connected with the second pressure regulating valve, and the oxidizer line between a first oxidizer line cut-off valve of the oxidizer feeding line and the gasification burner is connected to the shield gas line through a second shield gas cut-off valve.

The operating process is as follows:

1. The coal-water slurry circulating valve is opened, and meanwhile the first slurry line cut-off valve and a second slurry line cut-off valve of the coal-water slurry feeding line are closed, so as to set up the feeding flow of the coal-water slurry through the coal-water slurry circulating line corresponding to the gasification burner;
2. The first shield gas cut-off valve of the shield gas line is opened to allow the shield gas to enter into gasification burner;
3. The oxidizer vent valve is opened, and meanwhile the first oxidizer line cut-off valve and a second oxidizer line cutoff valve of the feeding line are closed, and the feeding flow of the oxidizer is set up through the oxidizer vent line corresponding to the gasification burner;
4. The second shield gas cut-off valve of the shield gas line is opened to allow the shield gas entering into the gasification burner;
5. The first pressure regulating valve and/or the first restriction orifice on the coal-water slurry circulating line are regulated to make the pressure of the coal-water slurry 0.05 to 2.5 MPa higher than the gasifier's operating pressure;
6. The second pressure regulating valve and/or the second restriction orifice on the oxidizer vent line are regulated to make the pressure of the oxidizer 0.05 to 4 MPa higher than the gasifier's operating pressure;
7. Upon determining that the pressure and flow parameters of the coal-water slurry and the oxidizer are normal and the gasifier runs smoothly, the gasification burner's online and pressurized feeding is initiated:
   a. The coal-water slurry circulating valve is closed, the first and second slurry line cut-off valves of the coal-water slurry feeding line are opened, the first shield gas cut-off valve of the shield gas line is closed, and the coal-water slurry enters into the gasifier through the gasification burner;
   b. The oxidizer vent valve is closed, the first and second oxidizer cut-off valves of the oxidizer feeding line are opened, the second shield gas cut-off valve of the shield gas line is closed, and the oxidizer enters the gasifier through the gasification burner;

8. the rotational speed of the coal-water slurry pump and the opening degree of the oxidizer flow regulating valve are regulated to enable the operating load of the gasification burner to be normal.

An advantageous effect of the invention is to realize an online, continuous and pressurized feeding during the operation of the gasifier after some burners which have stalled not due to their own reasons are fixed, which greatly reduces the probability of emergency breakdown of gasifiers, improves the reliability of a multi-nozzle-opposed gasifier's long-cycle operation and has a great significance on improving the operating stability and continuity of the whole production system.

These and other features and advantages of the present invention can be better understood by reading the following detailed description, taken together with the drawings.

DETAILED DESCRIPTION OF THE DRAWINGS

Figure 1:
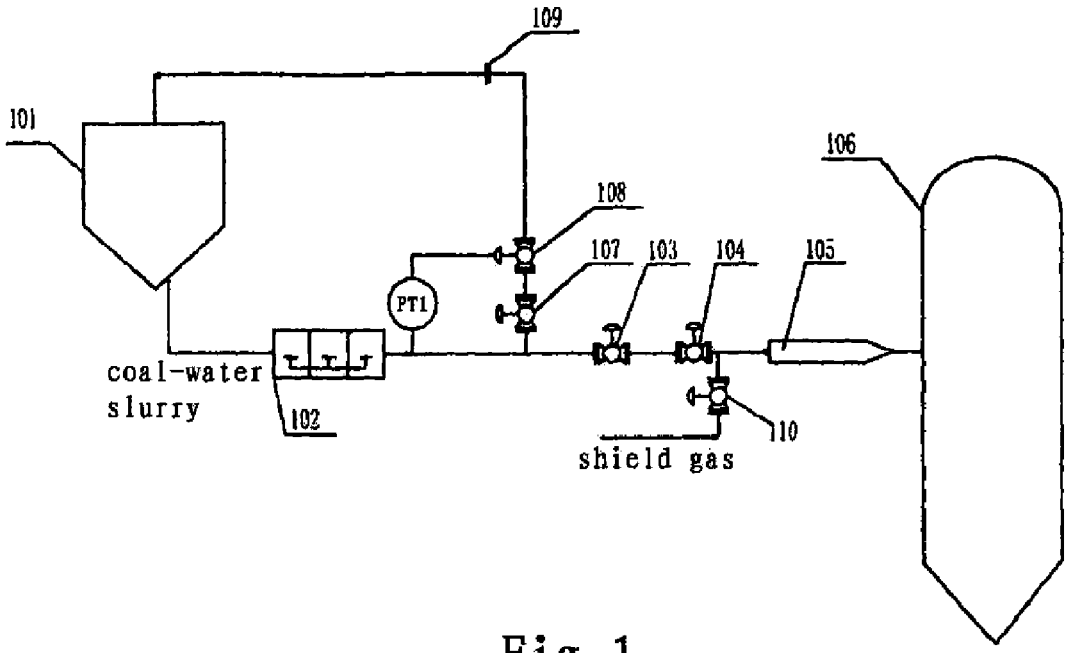
FIG. 1 illustrates a mechanism for feeding a coal-water slurry during the process of coal-water slurry gasification.

Referring to FIG. 1, 101 is a coal-water slurry tank, 102 is a coal-water slurry pump, 103 is a second slurry line cut-off valve, 104 is a first slurry line cut-off valve, 105 is a gasification burner, 106 is a gasifier, 107 is a coal-water slurry circulating valve, 108 is a first pressure regulating valve, 109 is a first restriction orifice, 110 is a first shield gas cut-off valve, and $PT_1$ is a pressure transmission control device.

Figure 2:
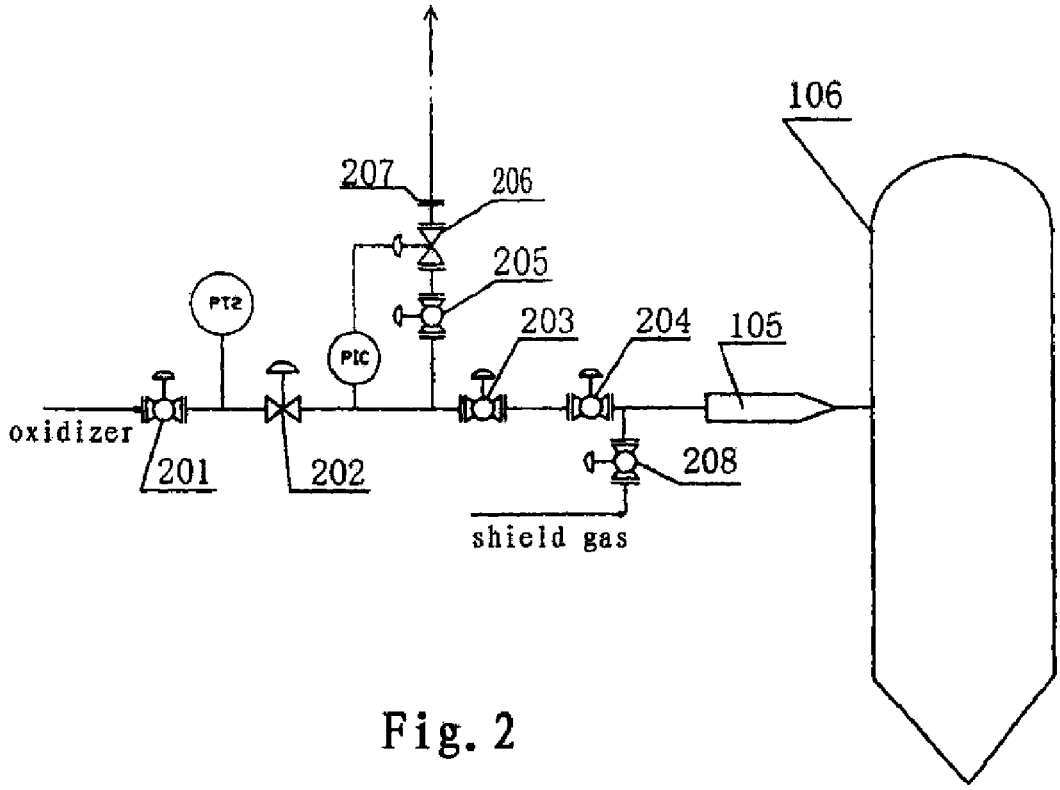
FIG. 2 illustrates a mechanism for feeding an oxidizer during the process of coal-water slurry gasification.

Referring to FIG. 2, 201 is a cut-off valve, 202 is a flow regulating valve, 203 is a second oxidizer line cut-off valve, 204 is a first oxidizer line cut-off valve, 205 is an oxidizer vent valve, 206 is a second pressure regulating valve, 207 is a second restriction orifice, 208 is a second shield gas cut-off valve, $PT_2$ is a pressure transmission control device, and PIC is a pressure display control device.

The present invention will be further described in conjunction with the accompanying drawings.

As shown in FIG. 1, the following steps should be completed by the coal-water slurry feeding and circulating lines prior to the gasification burner's online pressurized feeding:

1. The coal-water slurry feeding line is connected to the inlet of coal-water slurry pump 102 via the bottom opening of the coal-water slurry tank 101, and the outlet of the coal-water slurry pump 102 is connected to the gasification burner 105 via the slurry line cut-off valves 103 and 104. The coal-water slurry line between the first slurry line cut-off valve 104 and the gasification burner 105 is connected to the shield gas line via the first shield gas cut-off valve 110.

2. The coal-water slurry circulating line leads to the upper opening of the coal-water slurry tank 101 from the outlet of the coal-water slurry pump 102 via the circulating valve 107, the first pressure regulating valve 108 and the first restriction orifice 109. A pressure transmission control device $PT_1$ is connected to the outlet of the coal-water slurry pump 102, the control end of said device $PT_1$ is connected to the first pressure regulating valve 108.

The slurry line cut-off valves 103 and 104 which correspond to the stalling gasification burner 105 and are provided on the line of the gasifier 106 receiving the coal-water slurry are kept shut off, the coal-water slurry pump 102 is opened, the circulating valve 107 on the circulating line is opened, the coal-water slurry flows through the circulating valve 107, the first pressure regulating valve 108 and the first restriction orifice 109, and then returns to the coal-water slurry tank 101, and thus a coal-water slurry feeding flow is set up. The flow of coal-water slurry is regulated through the rotational speed of the coal-water slurry pump 102. The pressure of the coal-water slurry can be raised through independent regulation of the first pressure regulating valve 108 or the first restriction orifice 109, or raised by the combined regulation of the first pressure regulating valve 108 and the first restriction orifice 109, so as to make the pressure of the coal-water slurry 0.05 to 2.5 MPa higher than the operating pressure of the gasifier, preferably 0.4 to 1.0 MPa higher. The coal-water slurry line between the first slurry line cut-off valve 104 and the gasification burner 105 is protected by shield gas, namely when the first shield gas cut-off valve 110 is opened, the shield gas is let in. In this way, it can guarantee that during the feeding process, only the coal-water slurry flows into the gasifier 105, and the reversal flow of substances in the gasifier 105 can be prevented.

As shown in FIG. 2, the following steps should be completed by the oxidizer feeding and vent lines prior to the gasification burner's online pressurized feeding:

1. The oxidizer feeding line is connected to the gasification burner 105 through the cut-off valve 201, the flow regulating valve 202, the second oxidizer line cut-off valve 203, and the first oxidizer line cut-off valve 204; the pressure transmission control device $PT_2$ is coupled to the line between the cut-off valve 201 and the flow regulating valve 202. The oxidizer line between the first oxidizer line cut-off valve 204 and the gasification burner 105 is connected to the shield gas line via the second shield gas cut-off valve 208.

2. The oxidizer vent line leads from the flow regulating valve 202 to the atmosphere via the vent valve 205, the second pressure regulating valve 206 and the second restriction orifice 207. A pressure display control device PIC is arranged following the oxidizer flow regulating valve 202, the control end of the device PIC being connected to the second pressure regulating valve 206.

The oxidizer line cut-off valves 203 and 204 which correspond to the stalling gasification burner 105 and are provided on the line of gasifier 106 receiving oxidizer are kept shut off, the oxidizer cut-off valve 201 entering the gasification burner system, the flow regulating valve 202, and the vent valve 205 on the vent line are opened, the oxidizer is vented to the atmosphere through the cut-off valve 201, flow regulating valve 202, the vent valve 205, the second pressure regulating valve 206 and the second restriction orifice 207, and thus an oxidizer feeding flow is set up. The oxidizer flow is regulated by the flow regulating valve 202. The pressure of the oxidizer can be raised through independent regulation of the second pressure regulating valve 206 or the second restriction orifice 207, or raised by the combined regulation of the second pressure regulating valve 206 and the second restriction orifice 207, so as to make the pressure of the oxidizer 0.05 to 4 MPa higher than the operating pressure of the gasifier, preferably 0.5 to 1.5 MPa higher. The oxidizer line between the first oxidizer line cut-off valve 204 and the gasification burner 105 is protected by shield gas, namely when the second shield gas cut-off valve 208 is opened, the shield gas is let in. In this way, it can be ensured that during the feeding process, only the oxidizer flows into the gasifier, while the reversal flow of substances in the gasifier can be prevented.

The coal-water slurry line between the first coal-water slurry cut-off valve 104 and the gasification burner and the oxidizer line between the first oxidizer line cut-off valve 204 and the gasification burner are both protected by shield gas.

Therefore, upon online pressurized feeding of the gasification burner 105, the high-temperature medium in the gasifier will not enter into the coal-water slurry line and the oxidizer line, and then the coal-water slurry and the oxidizer will not contact with the high-temperature medium directly in the lines, thus ensuring that the coal-water slurry and the oxidizer can reach the gasifier 106 simultaneously for gasification burning and then potential risks can be avoided.

Upon determining that all the technical parameters are normal and the gasifier 106 runs smoothly, the gasification burner 105 performs the online pressurized feeding: the coal-water slurry circulating valve 107 is closed, the slurry line cut-off valves 103 and 104 are opened, the first shield gas cut-off valve 110 is closed, and then the coal-water slurry enters the gasifier, the oxidizer vent valve 205 is closed, the oxidizer line cut-off valves 203 and 204 are opened, the second shield gas cut-off valve 208 is closed, and then the oxidizer enters the gasifier. After both the coal-water slurry and the oxidizer have entered into the gasifier 106 through the gasification burner 105, the operating load of the gasification burner 105 is regulated to be normal, i.e. regulating the coal-water slurry pump 102 and the flow regulating valve 202, so that upon pressurized feeding the load of gasification burner 105 is at normal level, the load during pressurized feeding being about half of the normal load.

Various modifications may be made without departing from the spirit or scope of the general inventive concept as defined by the appended claims and their equivalents. The following embodiment is only an illustration of a particular implementation of the present invention, and the present invention should not be limited to the embodiment.

As for a four-nozzle-opposed (two in pairs) coal-water slurry gasifier with a processing capacity of 1000-ton coal per day, it purely uses oxygen. The gasification pressure is 4.0 MPa, and the gasification temperature is 1300° C. Due to the breakdown of the coal-water slurry pump, the two opposed gasification burners A and B shut down, whereas the other pair of gasification burners C and D still work, and then the gasification system and the follow-up production system operate with half load. The coal-water slurry flow of burners C and D is 15 $m^3$/h (single gasification burner), and the oxygen flow is 6200 $Nm^3$/h (single gasification burner). After clearing the failure of the coal-water slurry pump, gasification burners A and B perform online pressurized feeding.

The slurry line cut-off valve 103 and the slurry line cut-off valve 104 corresponding to the gasification burners A and B and located on the line of the gasifier receiving coal-water slurry are kept shut off, and the circulating valve 107 on the circulating line is opened, and then the feeding flow of the coal-water slurry is set up. The coal-water slurry flow is regulated through the rotational speed of the coal-water slurry pump 102, and the flow regulation of each burner is 8 $m^3$/h. The pressure of the coal slurry is raised to 4.8 MPa by means of combining the first pressure regulating valve 108 and the first restriction orifice 109. The coal-water slurry line between the coal-water slurry line cut-off valve 104 and the gasification burner 105 is protected by nitrogen.

The oxidizer line cut-off valve 203 and the oxidizer line cut-off valve 204 corresponding to gasification burners A and B and located on the line of the gasifier receiving the oxygen are kept shut off, the vent valve 205 on the vent line is opened, the oxygen cut-off valve 201 entering the pair of gasification burner systems is opened, and then the feeding flow of oxygen is set up. The oxygen flow of each burner is regulated to be 3800 $Nm^3$/h by the flow regulating valve 202. The pressure of oxygen is raised to be 5.0 MPa by means of combining the second pressure regulating valve 206 and the second restriction orifice 207. The oxygen line between the first oxygen line cut-off valve 204 and the gasification burner is protected by nitrogen.

Upon determining that all the technical parameters are normal and the gasifier runs smoothly, gasification burners A and B perform online pressurized feeding: the coal-water slurry circulating valve 107 is closed, the slurry line cut-off valves 103 and 104 are opened, the first shield nitrogen cut-off valve 110 is closed, and then the coal-water slurry enters the gasifier; the oxygen vent valve 205 is closed, the oxydizer line cut-off valves 203 and 204 are opened, the second shield nitrogen cut-off valve 208 is closed, and then the oxygen enters the gasifier. After both the oxygen and the coal-water slurry have entered into the gasifier 106 through the pair of gasification burners A and B, the operating load of the pair of gasification burners is regulated to be normal.

What is claimed is:

1. A method of feeding a gasification burner, wherein a first pressure regulating valve is applied to a coal-water slurry circulation line of a gasifier, a pressure transmission control device is connected to an outlet of a coal-water slurry pump, a control end of the pressure transmission control device being connected to the first pressure regulating valve, a coal-water slurry line between a first slurry line cut-off valve and the gasification burner is connected to a shield gas line through a first shield gas cut-off valve, a second pressure regulating valve is applied to an oxidizer vent line of the gasifier, and a pressure display control device is connected to an outlet of a flow regulating valve, a control end of the pressure display control device being connected to the second pressure regulating valve; an oxidizer line between a first oxidizer line cut-off valve and the gasification burner is connected to the shield gas line through a second shield gas cut-off valve, the method comprising:

opening a coal-water slurry circulating valve, and closing the first slurry line cut-off valve and a second slurry line cut-off valve, the second slurry line cut-off valve applied to the coal-water slurry line between the first slurry line cut-off valve and the coal-water slurry recirculation line, and then beginning a feeding flow of a coal-water slurry through the coal-water slurry circulating line;

opening the first shield gas cut-off valve to allow a shield gas to enter into the gasification burner;

opening an oxidizer vent valve applied to an oxidizer vent line, the oxidizer vent line being connected to the oxidizer line, and closing the first oxidizer line cut-off valve and a second oxidizer line cut-off valve, and then beginning a feeding flow of an oxidizer through the oxidizer vent line, the second oxidizer line cut-off valve applied to the oxidizer line between the first oxidizer line cut-off valve and the oxidizer vent line;

opening the second shield gas cut-off valve to allow the shield gas to enter into the gasification burner;

regulating at least one of a) the first pressure regulating valve and b) a first restriction orifice on the coal-water slurry circulating line to make the pressure of the coal-water slurry 0.05 to 2.5 MPa higher than an operating pressure of the gasifier;

regulating at least one of a) the second pressure regulating valve and b) a second restriction orifice on the oxidizer vent line to make the pressure of the oxidizer 0.05 to 4 MPa higher than the operating pressure of the gasifier;

upon determining that pressure and flow parameters of the coal-water slurry and the oxidizer are normal and that the gasifier operates smoothly, initiating the gasification burner's online pressurized feeding by closing the coal-water slurry circulating valve, opening the first slurry line cut-off valve and the second slurry line cut-off valve, and closing the first shield gas cut-off valve, thereby allowing the coal-water slurry to enter into the gasifier through the gasification burner, and closing the oxidizer vent valve, opening the first oxidizer line cut-off valve and the second oxidizer line cut-off valve, and closing the second shield gas cut-off valve, thereby allowing the oxidizer to enter into the gasifier through the gasification burner; and regulating a rotational speed of the coal-water slurry pump and an opening degree of the oxidizer flow regulating valve to normalize an operating load of the gasification burner.

2. The method according to claim 1, wherein the pressure of said coal-water slurry is 0.4 to 1.0 MPa higher than the operating pressure of the gasifier.

3. The method according to claim 1, wherein the pressure of said oxidizer is 0.5 to 1.5 MPa higher than the operating pressure of the gasifier.

4. The method according to claim 1, wherein said shield gas is any one of nitrogen, vapor and carbon dioxide.

5. A method of feeding a gasification burner of a gasifier comprising:

circulating a coal-water slurry through a coal-water slurry circulation line connected to a coal-water slurry line by closing at least one slurry line cut-off valve and opening a coal-water slurry circulating valve;

directing an oxidizer from an oxidizer line to an oxidizer vent line by closing at least one oxidizer line cut-off valve and opening an oxidizer vent valve;

directing a shield gas from a shield gas line into to the coal-water slurry line between the at least one slurry line cut-off valve and a gasification burner, the at least one slurry line cut-off valve disposed between the coal-water slurry circulation line and the shield gas line;

directing the shield gas from the shield gas line into the oxidizer line between the at least one oxidizer line cut-off valve and the gasification burner, the at least one oxidizer line cut-off valve disposed between the oxidizer vent line and the shield gas line;

monitoring at least one of a) pressure parameters and b) flow parameters of the coal-water slurry monitoring at least one of a) pressure parameters and b) flow parameters of the oxidizer;

while circulating the coal-water slurry through the coal-water slurry circulation line, adjusting the pressure of the coal-water slurry to be 0.05 to 2.5 MPa higher than an operating pressure of the gasifier;

while directing the oxidizer to the oxidizer vent line, adjusting the pressure of the oxidizer to be 0.05 to 4 MPa higher than the operating pressure of the gasifier;

upon determining that the parameters of the coal-water slurry and the oxidizer are normal, initiating online pressurized feeding of the gasification burner by closing the coal-water slurry circulating valve, opening the at least one slurry line cut-off valve, and closing the first shield gas cut-off valve, thereby allowing the coal-water slurry to enter into the gasifier through the gasification burner, and closing the oxidizer vent valve, opening the at least one oxidizer line cut-off valve, and closing the second shield gas cut-off valve, thereby allowing the oxidizer to enter into the gasifier through the gasification burner; and normalizing an operating load of the gasification burner by regulating the flow of the coal-water slurry and the flow of the oxidizer.

6. The method according to claim 5, wherein the pressure of said coal-water slurry is 0.4 to 1.0 MPa higher than the operating pressure of the gasifier.

7. The method according to claim 5, wherein the pressure of said oxidizer is 0.5 to 1.5 MPa higher than the operating pressure of the gasifier.

8. The method according to claim 5, wherein the shield gas is any one of nitrogen, vapor, and carbon dioxide.

* * * * *